US005388851A

United States Patent [19]

Challande et al.

[11] Patent Number: 5,388,851

[45] Date of Patent: Feb. 14, 1995

[54] ALPINE SKI SAFETY BINDING

[75] Inventors: Christian Challande, Cruseilles; Gilles R. Goud, Cran-Gevrier, both of France

[73] Assignee: Salomon S.A., Chavanod, France

[21] Appl. No.: 981,230

[22] Filed: Nov. 25, 1992

[30] Foreign Application Priority Data

Nov. 25, 1991 [FR] France ..... 91 14756

[51] Int. Cl.[6] ..... A63C 9/085

[52] U.S. Cl. ..... 280/625; 280/629; 280/634

[58] Field of Search ..... 280/625, 626, 628, 634, 280/629, 632, 633

[56] References Cited

U.S. PATENT DOCUMENTS

| | | | |
|---|---|---|---|
| 3,455,570 | 7/1969 | Salomon | 280/629 |
| 3,604,720 | 9/1971 | Reuge et al. | 280/634 X |
| 3,638,959 | 2/1972 | Reuge | 280/625 |
| 4,592,569 | 6/1986 | Nowak et al. | 280/625 X |
| 4,756,545 | 7/1988 | Freisinger et al. | 280/628 X |
| 4,867,471 | 9/1989 | Stritzl et al. | 280/628 X |
| 5,028,069 | 7/1991 | Janisch et al. | 280/625 |
| 5,044,658 | 9/1991 | Challande et al. | 280/634 X |
| 5,056,810 | 10/1991 | Rigal | 280/625 |

FOREIGN PATENT DOCUMENTS

| | | | |
|---|---|---|---|
| 0407707 | 1/1991 | European Pat. Off. | 280/634 |
| 2640516 | 6/1990 | France . | |
| 1937501 | 2/1971 | Germany . | |
| 474278 | 4/1969 | Switzerland | 280/628 |

*Primary Examiner*—Brian L. Johnson

*Attorney, Agent, or Firm*—Pollock, Vande Sande & Priddy

[57] ABSTRACT

Front ski binding designed to hold the end of a boot supported on a ski. The binding comprises a base (3) and a body (8) which moves in relation to the base (3) and parallel to a vertical median longitudinal plane of the ski. The body carries, moreover, a mechanism (15) for position retention of the front end of the boot. The front parts of the body (8) and the base (3) are connected, so as to allow the body (8) to pivot in relation to the base and parallel to the vertical, median longitudinal plane of the ski. An elastic return mechanism (30), distinct from the elastic return device (26) which returns the wings (21) of the position-retention mechanism, connects the body (8) to the base (3) and elastically returns the rear part of the body (8) toward the base (3).

7 Claims, 4 Drawing Sheets

FIG. 3
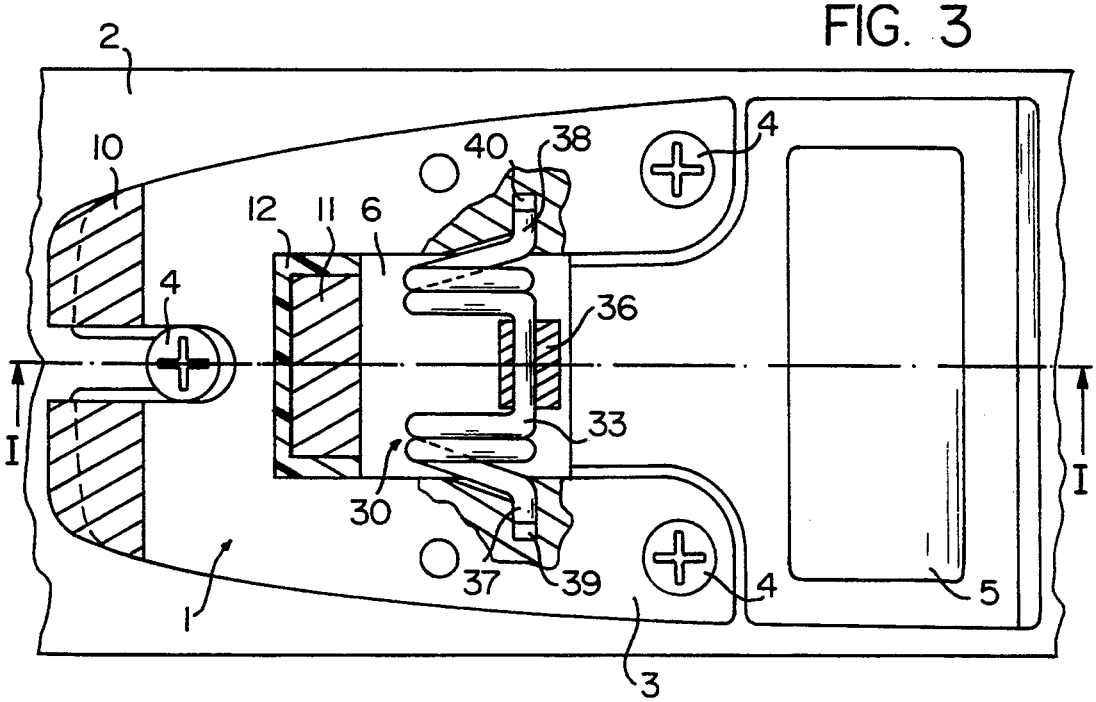
FIG. 4
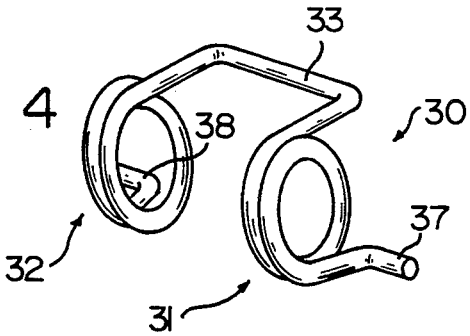
FIG. 4a
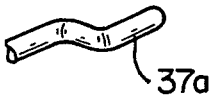
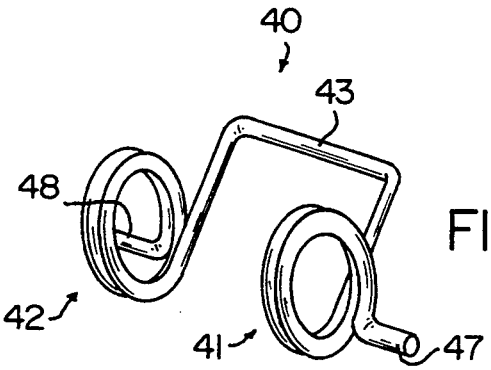
FIG. 5

ALPINE SKI SAFETY BINDING

FIELD OF THE INVENTION

The invention concerns a front ski binding designed to hold the end of a boot supported on a ski and to release this end when it exerts excessive stress on the binding.

BACKGROUND OF THE INVENTION

Conventional front ski bindings normally comprise a base designed to be fastened to the ski and a body carried by this base in which an elastic return mechanism is generally housed. The body supports, in turn, a position-retention mechanism which is most frequently formed by a vertical stop, or sole-clamp, which holds the end of the boot vertically, and two lateral wings which hold the boot end in position laterally. Stresses are transmitted from the boot to the elastic return device by means of the position-retention mechanism.

Among currently-known bindings, the invention concerns, more specifically, those incorporating a body which is movable vertically but not laterally, and which is connected to the base in the front part of the binding.

Such a binding is known, for example, applicant's French Patent Application No. 2 640 516. This binding has a body which moves vertically in relation to the base and counter to the return force generated by an elastic device housed inside the body. An elastically deformable area located in the front part of the binding attaches the body to the base without gaps. The wings in this binding are jointed to the body and can move laterally in opposition to the return force of an energy spring. The means which provide for the vertical return of the body comprise a vertical rod connected to a jointed rocker. The rocker comprises, in turn, an arm resting against a piston. By means of this piston, the energy spring is stressed by the vertical elevation of the body, or by the lateral opening of the wings. The body is thus vertically movable in response to vertical stress generated by the boot in opposition to the return force of the spring, which is transmitted to it by the rocker and the rod.

The elevation of the body either allows automatic adaptation of the binding to the thickness of the sole, or facilitates release of the boot in the event the skier falls backward.

This construction gives good results, but its use requires several mechanical parts produced in accordance with relatively close tolerances.

SUMMARY OF THE INVENTION

One purpose of the invention is to add elastic vertical body-return means which can be easily incorporated into the binding, i.e., a mechanism whose nature and bulk allow it to perform the function sought, i.e., return of the body, without impairing the operation of the binding and without requiring significant modifications of the binding.

One of the purposes of the present invention is to propose a binding of this type, in which vertical elastic return of the body is effected by a simpler device, which is thus more economical to manufacture.

Other purposes and advantages of the invention will emerge from the following description.

The front ski binding comprises a base by means of which the binding is assembled to the ski. It further comprises a body which, in relation to the base, can move parallel to the vertical, median longitudinal plane of the ski. The body carries a mechanism for position-retention of the end of the boot, this element comprising a sole-clamp solidly attached to the body so as to allow vertical motion, and two lateral wings which move in relation to the body in opposition to the return force of an energy device housed in the body or the base. The front portions of the body and the base are joined so as to permit a swinging motion of the body parallel to the vertical, median longitudinal plane of the ski in response to a vertical stress generated by the boot on the sole-clamp.

This binding is characterized by the fact that an elastic return mechanism distinct from the elastic return device used for the return motion of the wings connects the rear part of the body to the base and elastically returns the rear part of the body toward the base.

BRIEF DESCRIPTION OF THE DRAWINGS

The invention will be better understood with reference to the following description and to the attached drawings.

FIG. 3 is a cross-section along line III—III of the FIG. 1.

FIG. 4 is a perspective view of a mechanism designed to return the body elastically toward the base, according to one embodiment of the invention. FIG. 4*a* shows a variant of this elastic return mechanism.

FIG. 5 is a variant of the device in FIG. 4.

DESCRIPTION OF THE PREFERRED EMBODIMENT

Figure 1:
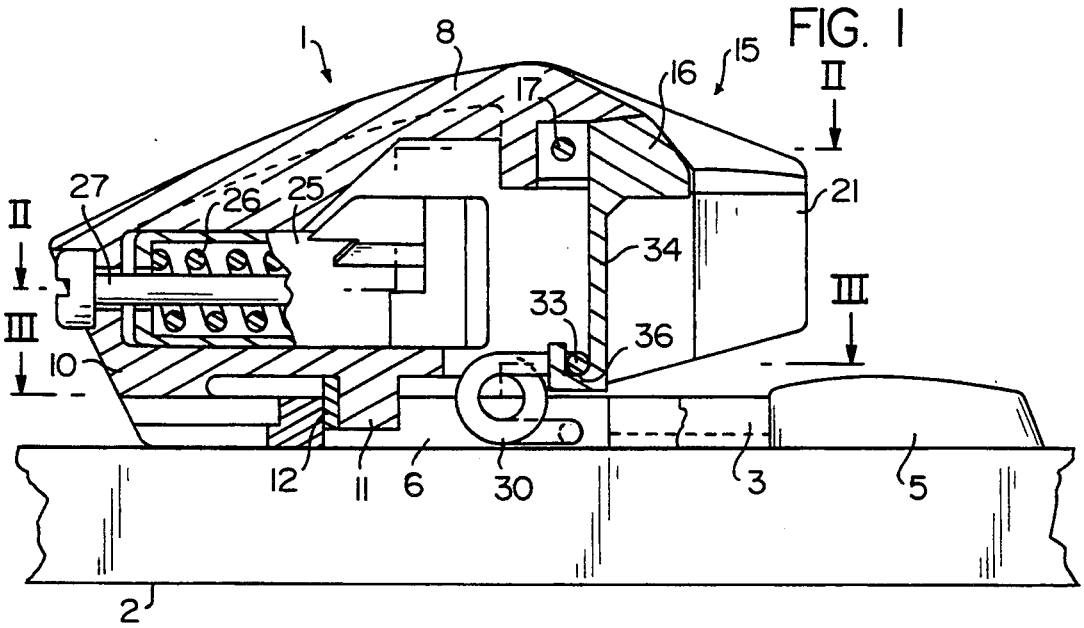
FIG. 1 is a side cross-section view of a front binding according to a first embodiment of the invention.
Figure 2:
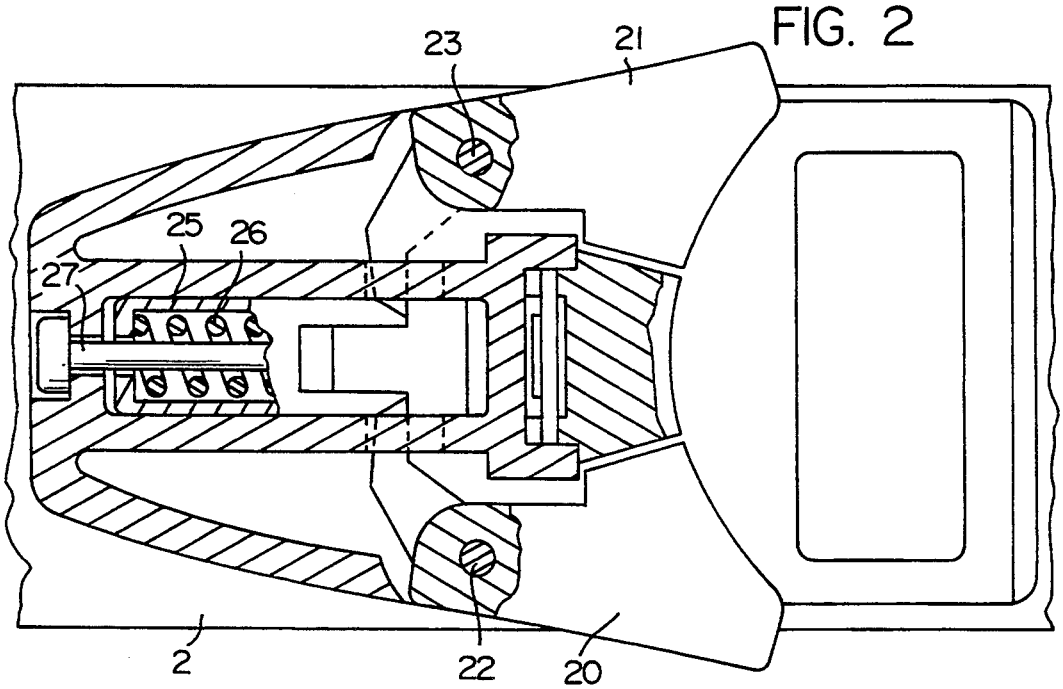
FIG. 2 is a cross-section along line II—II of the device shown in FIG. 1.

FIGS. 1 to 3 represent a binding 1 assembled to a ski 2. The binding 1 has numerous features similar to those already disclosed in applicant's French Patent Application No. 2 640 516.

In particular, the binding 1 comprises a base 3 by which the binding is assembled to the ski using any suitable means, e.g., screws 4. The base 3 is extended rearward by a support plate 5, on which the front end of the boot rests during skiing. Seen from above, the base 3 is shaped like a U open to the rear, a configuration creating a recess 6 in its central portion.

The binding 1 further comprises a body 8 attached to the base 3 by an elastically deformable zone 10. This zone 10 connects the body 8 and the base 3 without gaps, in such a way that these three parts actually form a one-piece component. In the illustrated embodiment, this zone is located in the front portion of the binding.

A stud 11, preferably equipped with a peripheral fitting 12, is provided in the lower portion of the body. The stud 11 extends vertically toward the base, in which it is inserted between the two lateral arms of the U. The stud has a lateral dimension which substantially corresponds to the width of the recess 6, and it guides the body 8 in relation to the base 3 during its vertical movements.

The elastically deformable zone 10, in conjunction with the stud 11, allows the body 8 to pivot parallel to the vertical, median longitudinal plane of the ski, i.e., the plane in FIG. 1. However, this method of joining the body and the base is not restrictive and any other suitable method could, in effect, be used, such as an articulation formed by a transverse pin positioned between the body and the base, or the cooperation of raised, projecting shapes belonging to the body and the base, which create an axis of rotation allowing the body to turn on the base. A binding of this type is described, for example, in U.S. Pat. No. 5,056,810.

The front portion of body 8 supports a position-retention mechanism 15 designed to hold the end of the boot supported on the ski, and thus, to counter the stresses generated by the boot in vertically upward, lateral or forwardly longitudinal directions. The position-retention mechanism 15 comprises, in particular, a sole clamp 16 which provides, for the front end-piece of the boot, a horizontal support surface which allows the boot to be held in place vertically. In the example shown, the sole clamp 16 is an added piece assembled to the body by virtue of the cooperation of matching shapes and of a pin, shown schematically at 17.

The position-retention mechanism 15 further comprises two lateral position-retention wings 20 and 21, which are jointed to the body around approximately vertical axes 22 and 23. The wings comprise, beyond axes 22 and 23, small arms whose ends rest on a piston 25, which is guided within the body 8 so as to describe a longitudinal motion. The movement of the piston 25, which takes place when stress is exerted upon opening of one of the wings, occurs in opposition to the elastic return force generated by a spring 26. The prestressing of the spring can be adjusted conventionally by using a screw 27.

Accordingly, the lateral stresses generated by the boot on the position-retention mechanism 15 are transmitted to the spring 26 and, depending on their intensity, one of the wings opens sufficiently to allow release of the end of the boot.

On the other hand, upward vertical stresses are harnessed by the sole clamp 16. Since this sole clamp is attached to the body 8, these stresses tend to raise the body 8, i.e., to cause the body 8 to pivot in relation to the elastically deformable zone 10.

According to the invention, an elastic-return mechanism connects the rear part of the body to the base, so as to oppose these movements elastically. This elastic-return mechanism is distinct from the energy means effecting the elastic return movement of the lateral wings 20 and 21, i.e., the spring 26.

In the embodiment shown in FIGS. 1 to 3, the vertical elastic body-return mechanism is a coil spring 30, visible in more detail in FIG. 4. This coil spring 30 is partially housed in the recess 6 in the base 3, and partially in a recess in the body located to the rear of stud 11.

Spring 30 comprises two symmetrical lateral coils 31 and 32, which are connected together by an elevated central horizontal portion 33 which is preferably offset substantially rearward in relation to the coils 31 and 32. This central portion 33 is designed to fit into the hook-shaped lower part 36 of a downward extension 34 of the sole-clamp 16. Accordingly, for all vertical movements, in particular upward movements, central portion 33 is connected to the body by means of the sole-clamp 16. The dimensions of the extension 34 measured in cross-section are such as to support at least the maximum return force generated by the spring 30.

The free ends of the spring 30 are provided with catch means for attachment to the base. These means are illustrated in the form of ends 37, 38 bent laterally outward 37, 38. The ends 37 and 38 are engaged in recesses 39, 40 provided in the two lateral arms of the base in order to receive these ends. The base 3 absorbs the return stresses of the springs generated by the vertical movements of the body 8.

As a variant, FIG. 4*a* illustrates an end 37*a* which is extended by a bent segment extending longitudinally rearward. The recesses in the base have, in this case, a matching shape for receiving these ends incorporating double bends. This arrangement distributes over a greater length the stresses which the ends of the spring 30 transmit to the base. Moreover, the return energy of the spring is produced not only by deformation of the turns, but also by torsion of the ends 37*a*.

The number of turns in each coil 31 and 32 is not restrictive. In the example shown, there are approximately one and one-half turns.

According to the preceding description, it will be understood that the vertical upward movements of the body pull each coil 31 and 32 of the spring 30 so that it extends, or, in other words, unwinds.

FIG. 5 illustrates a variant in which the spring 40 works in the opposite way, i.e., by winding. This spring has coils 41 and 42 extending in the direction opposite that of the coils 31 and 32, but comprises a central part 43 and free ends 47 and 48 similar to the elements 33, 37, and 38 of spring 30.

Figure 6:
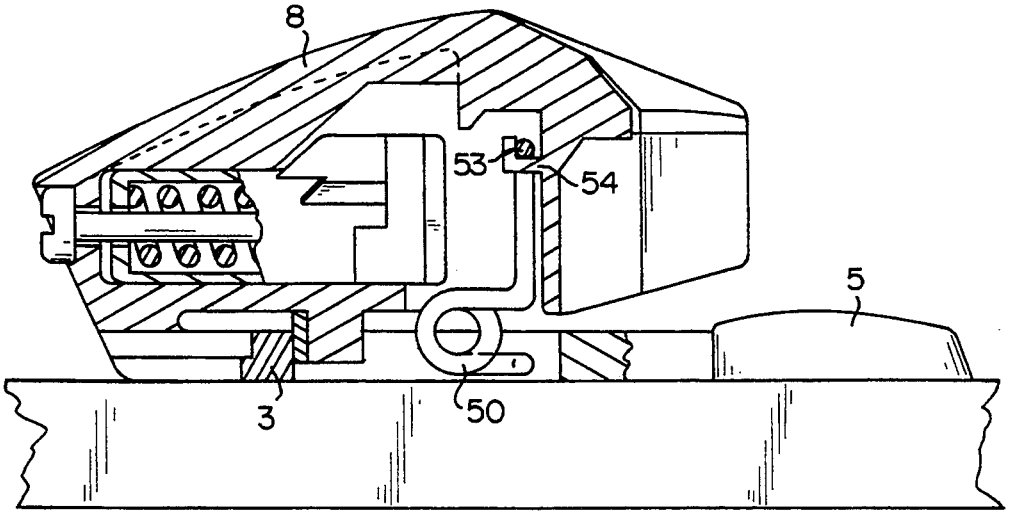
FIG. 6 illustrates a variant of the binding shown in FIG. 1.

FIG. 6 illustrates yet another variant, in which the spring 50 comprises coils running in a direction similar to that of the spring 30. On the other hand, the central part 53 is shifted substantially upward in relation to the coils so as to hook onto the upper part of the body, in a housing 54 located at approximately the height of the horizontal surface of the sole-clamp.

The operation of the device just described is as follows. During skiing, the boot subjects the front binding to stresses, in particular to vertical, upward stresses. The latter are transmitted to the body 8 by means of the sole-clamp, and cause the body to pivot upward around the elastically-deformable zone 10, counter both to the elastic return force, or the elastic return moment generated by this zone, and to the elastic return force generated by the spring 30, 40, or 50. It will be recalled, that as already noted, this latter elastic return force is distinct from the energy spring 26, and thus, from the adjustment of spring 26 relating to the lateral opening motion of the wings.

Figure 7:
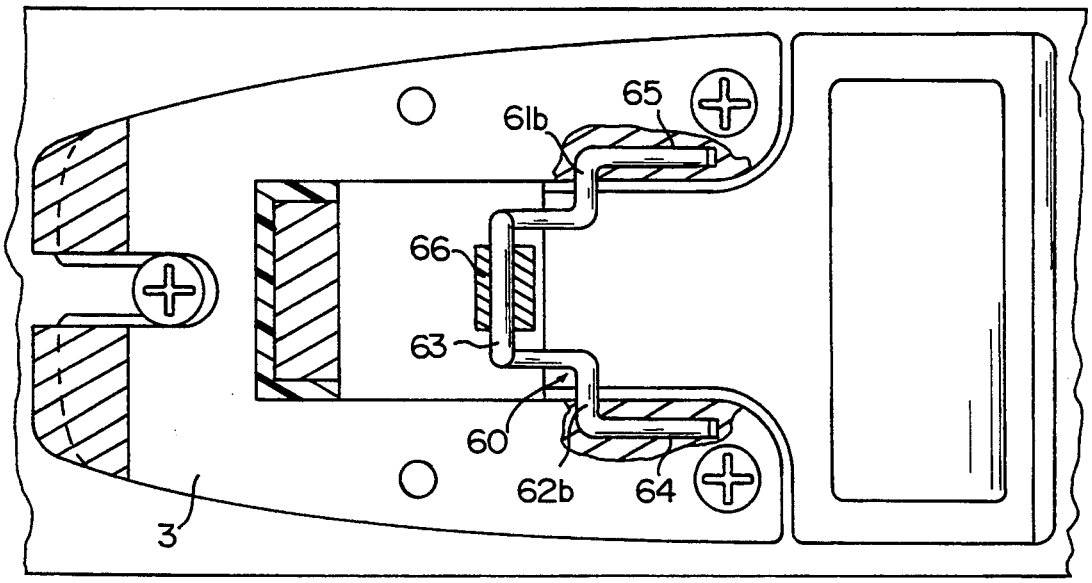
FIG. 7 illustrates another variant of the elastic body-return mechanism.

FIG. 7 illustrates a variant of the invention, according to which the elastic return mechanism belonging to the body is a spring 60 which works mainly under torsion.

The binding illustrated in FIG. 7 is, in other respects, similar to that described with reference to FIGS. 1 to 3. It will, therefore, not be described in detail.

Figure 8:
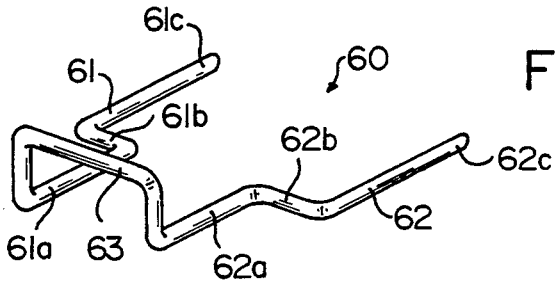
FIG. 8 is a perspective view of the elastic return mechanism belonging to the device illustrated in FIG. 7.

The spring 60 can be seen in perspective in FIG. 8. It has a central horizontal, elevated part 63 housed in the lower hook-shaped part 66 of a mounted element identical to the sole-clamp 16 in FIG. 1.

On each side of the central part 63, the spring 60 comprises symmetrical parts 61, 62 each incorporating a double bend.

Each doubly-bent part 61, 62 has a longitudinal segment 61*a*, 62*a*, a transversely extending torsion segment 61*b*, 62*b*, and a longitudinal end segment 61*c*, 62*c*.

The end segments 61*c*, 62*c* and a portion of the torsion segments 61*b*, 62*b* are embedded in recesses 64 and 65 in the two lateral arms of the base 3.

The spring 60 thus uses the hook shaped part 66 to connect the body to the base 3, by means of recesses 64, 65.

The vertical movements of the body mainly stress the spring 60 under torsion in the area of the transverse torsion segments 61*b*, 62*b*. As in the preceding cases, the spring 60 assures the elastic return of the body toward the base, and the return force it generates is distinct from the return force of the energy spring which causes the return motion of the wings.

The spring 26 and the piston 25 could be positioned and guided in a recess located in the base, instead of in the body.

Similarly, the sole-clamp could be formed by the upper portion of the position-retention wings. Since these wings are jointed to the body around approximately vertical axes, they transmit directly to the body the vertical stresses to which the boot subjects them.

Finally, the spring could be replaced by another type of elastic return mechanism, e.g., a shock-absorption device.

What is claimed is:

1. Front ski binding designed to hold an end of a boot supported on a ski, and to release said end when said end subjects the binding to excessive stress, said front ski binding comprising:

(a) a base (3) and means for assembling said base to said ski;

(b) a body continuously connected to said base by an elastically deformable zone (10) located in a front portion of said body and of said base (3);

(c) a position-retention mechanism (15) supported by a front portion of said base and comprising a sole clamp (16) attached to said body and retaining said boot against vertical movement and two lateral retaining wings (20, 21) which are jointed to said body around substantially vertical axes (22, 23) and which are movable in an opening direction in relation to said body;

(d) a return spring (26) housed in said body and causing said wings to open in response to lateral stresses generated by said boot on said position-retention mechanism; and (e) a second spring (30, 40, 60) located in a rear portion of said body and being independent of said return spring, said second spring being hooked into both said body and into said base and elastically returning said rear portion of said body toward said base, said body including a means to receive said second spring in a lower portion thereof.

2. Binding according to claim 1, wherein said second spring is a coiled spring having coils (31, 32) which unwind upon extension of said coiled spring.

3. Binding according to claim 1, wherein said second spring is a coiled spring (43) having coils (41, 42) which wind upon extension of said coiled spring.

4. Binding according to claim 1, wherein said second spring (60) is a torsion spring.

5. Front ski binding designed to hold an end of a boot supported on a ski, and to release said end when said end subjects the binding to excessive stress, said front ski binding comprising:

(a) a base (3) and means for assembling said base to said ski;

(b) a body continuously connected to said base by an elastically deformable zone (10) located in a front portion of said body and of said base (3);

(c) a position-retention mechanism (15) supported by a rear portion of said body and comprising a sole clamp (16) attached to said body and retaining said boot against vertical movement and two lateral retaining wings (20, 21) which are jointed to said body around substantially vertical axes (22, 23) and which are movable in an opening direction in relation to said body;

(d) a return spring (26) housed in said body and causing said wings to open in response to lateral stresses generated by said boot on said position-retention mechanism;

(e) a second spring (30, 40, 50, 60) located in a rear portion of said body and being independent of said return spring, said second spring being hooked into both said body and into said base and elastically returning said rear portion of said body toward said base; and (f) a vertical extension (34) fastened to said rear portion of said body (8) and extending toward said base (3), said second spring being fitted into a lower part (36) of said extension (34).

6. Binding according to claim 5, wherein said sole clamp (16) is a piece mounted on said body (8) and forming a one-piece component with said vertical extension (34).

7. Front ski binding designed to hold an end of a boot supported on a ski, and to release said end when said end subjects the binding to excessive stress, said front ski binding comprising:

(a) a base (3) and means for assembling said base to said ski;

(b) a body continuously connected to said base by an elastically deformable zone (10) located in a front portion of said body and of said base (3);

(c) a position-retention mechanism (15) supported by a rear portion of said base and comprising a sole clamp (16) attached to said body and retaining said boot against vertical movement and two lateral retaining wings (20,21) which are jointed to said body around substantially vertical axes (22,23) and which are movable in an opening direction in relation to said body;

(d) a return spring (26) housed in said body and causing said wings to open in response to lateral stresses generated by said boot on said position-retention mechanism; and (e) a second spring (30,40,50) comprising a coil spring having a transversely oriented axis and located in a rear portion of said body and being independent of said return spring, said second spring being hooked into both said body and into said base and elastically returning said rear portion of said body toward said base.

* * * * *